US006557448B2

(12) United States Patent
Delagey et al.

(10) Patent No.: US 6,557,448 B2
(45) Date of Patent: May 6, 2003

(54) METHOD OF AND SYSTEM FOR DELIVERY OF WATER-BASED EXPLOSIVES

(75) Inventors: Mark Owen Delagey, Secunda (ZA); Gary Ashley Austen, Secunda (ZA); Derik Strydom, Secunda (ZA)

(73) Assignee: Sasol Chemical Industries Limited (ZA)

( * ) Notice: Subject to any disclaimer, the term of this patent is extended or adjusted under 35 U.S.C. 154(b) by 0 days.

(21) Appl. No.: 09/878,249

(22) Filed: Jun. 12, 2001

(65) Prior Publication Data

US 2002/0035917 A1 Mar. 28, 2002

Related U.S. Application Data

(60) Provisional application No. 60/216,158, filed on Jul. 3, 2000.

(51) Int. Cl.[7] ..... F42B 3/00
(52) U.S. Cl. ..... 86/20.15; 102/312; 102/313
(58) Field of Search ..... 86/20.15; 102/312, 102/313

(56) References Cited

U.S. PATENT DOCUMENTS 3,770,523 A * 11/1973 Biswas ..... 149/14
3,791,255 A * 2/1974 Fox et al. ..... 86/20.15
3,943,820 A * 3/1976 Persson ..... 86/20.15
4,003,429 A * 1/1977 Hay et al. ..... 166/51
4,685,375 A * 8/1987 Ross et al. ..... 86/20.15
4,699,060 A * 10/1987 Vuillaume et al. ..... 102/313
4,966,077 A * 10/1990 Halliday et al. ..... 102/313
4,987,818 A * 1/1991 Alford ..... 86/20.15
5,007,345 A * 4/1991 O'Garr ..... 102/313
5,712,440 A * 1/1998 Eagar et al. ..... 86/20.15

* cited by examiner

*Primary Examiner*—Peter A Nelson
(74) *Attorney, Agent, or Firm*—Finnegan, Henderson, Farabow, Garrett & Dunner, L.L.P.

(57) ABSTRACT

This invention relates to a method of delivering a water-based explosive by feeding a water-based explosive and a fluid non-explosive carrier into a tubular delivery member in order that the water-based explosive defines a plurality of bodies separated from each other by the carrier. The method further includes the step of feeding the bodies of water-based explosive separated by the carrier through the tubular delivery member to a point of delivery. The invention also relates to a system for delivering a water-based explosive especially to a system for carrying out the above method.

13 Claims, 4 Drawing Sheets

METHOD OF AND SYSTEM FOR DELIVERY OF WATER-BASED EXPLOSIVES

CROSS REFERENCE TO RELATED APPLICATION

This application claims the benefit of U.S. Provisional Application No. 60/216,158, filed Jul. 3, 2000, the content of which is incorporated herein by reference.

FIELD OF THE INVENTION

This invention relates to a method of and a system for delivering water-based explosives, especially into blastholes.

BACKGROUND TO THE INVENTION

The most widely used mass method for underground blasthole charging is by the pneumatic loading of ANFO (ammonium nitrate fuel oil). ANFO is a solid particulate explosive and is favoured for comparative cost, ease of use and the simple equipment required to load it into blast holes.

There are however several disadvantages to the use of ANFO. It is not water-resistant and cannot be applied effectively in wet mines. It is easily spilled and pneumatic loading or charging may result in a high percentage of blowouts affecting the quality of wastewater. Blowout dust is also a respiratory and skin irritant. Furthermore, being a straight mixture of ammonium nitrate and a fuel oil there is not much flexibility in the formulation, and blast manipulation to achieve the desired results is limited to mining practice, for example changing the burden and spacing of the pattern of boreholes.

Water-based explosives such as water-in-oil emulsion and so-called watergel explosives are two common underground mining explosive types which are used as alternatives to ANFO. These products have the advantage of being water-resistant. They can also be formulated with a wide range of available energy per unit volume, which is an important property of explosives. They are generally used in underground mining in cartridged form. The process of charging and consolidating explosive cartridges into a borehole is labour intensive, and it has been known to cause serious accidents if not done with sufficient care. Various methods and apparatus are in use for the direct charging of these explosive types from a mass container into blast holes. A disadvantage of current methods of direct charging of these explosive types is that detonative continuity is provided by the explosive from the blast hole to the mass container. Accordingly most of these methods employ the feed of non-explosive components from the mass container to a point near charging where the non-explosive components are mixed with a sensitiser to become explosive in the borehole. The most common approach with emulsion explosives is the admixture of a gassing component into the delivery hose near to the point of charging. The gassing component undergoes a chemical gassing reaction with the emulsion, thereby sensitising it to a detonative level.

Detonative continuity from the blast hole to the holding or mass container is interrupted by virtue of the insensitivity of the hose content between the mass container and the admixture of the gassing component. Disadvantages of this process include the fact that the integrity and quality of the explosive in the blasthole depends on the effectiveness of mixing the sensitiser with the non-explosive mixture. Mixing devices in these systems have the added disadvantage of increasing pump delivery pressures. Pumping pressures can be reduced by the use of water to form an annulus in the delivery hose, which acts as a lubricant, but only provided the annulus is maintained.

It is accordingly an object of the present invention to provide an alternative method of delivering fluid explosives and to provide a system for performing this method.

SUMMARY OF THE INVENTION

According to the present invention there is provided a method of delivering a water-based explosive comprising:

feeding a water-based explosive and a fluid non-explosive carrier into a tubular delivery member in order that the water-based explosive defines a plurality of bodies separated from each other by the carrier; and feeding the bodies of water-based explosive separated by the carrier through the tubular delivery member to a point of delivery.

Preferably the water-based explosive and carrier is fed into the delivery member in order that the water-based explosive defines a plurality of bodies separated from each other by the carrier to ensure that detonative continuity is not present in the delivery member.

Since the water-based explosive is delivered as a plurality of bodies separated by the non-explosive carrier it is easy to arrange, by simply varying the relative quantities of explosive and carrier, that detonative continuity is interrupted in at least one position between the point of delivery and point at which the water-based explosive is fed into the delivery member. This can be effected by having a higher feed rate of carrier fluid than a water-based explosive.

The water-based explosive and carrier may be fed into the delivery member to form a number of columns of water-based explosive, interrupted and separated by the carrier. Preferably the carrier also forms an annulus in the tubular delivery member through which the columns of water-based explosive pass in order to provide lubricity between the explosive and the wall of the tubular delivery member. Alternatively the water-based explosive and carrier may be fed into the delivery member to form a plurality of smaller bodies. This is especially the case where the carrier fluid comprises a gas.

The water-based explosive and carrier may be fed into the delivery member by means of an enveloper comprising a hollow body with an inlet for the carrier, an inlet for the explosive, and a joint outlet for the carrier and explosive; the arrangement being such that the carrier in use breaks up the explosive into bodies separated by the carrier which leave the enveloper through the outlet. Alternatively the water-based explosive and/or carrier may be fed in alternating fashion into the delivery member. This may be achieved by interrupting the feed of the water-based explosive and/or carrier into the delivery member in an alternating fashion. Preferably the feed of both the water-based explosive and carrier is interrupted and preferably the feed is interrupted in a synchronised alternating sequence resulting in alternate delivery of explosive and carrier into the delivery member. The interruption may be effected by a suitable valve arrangement.

The water-based explosive may comprise an emulsion explosive or an emulsion explosive containing other ingredients such as ammonium nitrate and/or aluminium. Alternatively it may comprise a watergel explosive. In all cases the water-based explosive may be chemically altered, for example by cross-linking, in such a way that it sets into a semi-rigid body after it is ejected from the tubular delivery member.

The water-based explosive may be viscous, even highly viscous and the viscosity of the water-based explosive may fall in the range from 40 000 cps to 700 000 cps preferably from 250 000 to 500 000 cps.

The water-based explosive may be sensitised for direct use in blastholes in which it is intended to be used. Although aforementioned is a preferred embodiment, additional sensitiser may be added prior to delivery of the water-based explosive.

The water-based explosive may be sensitive to initiation by booster or priming charge, but may also be sensitive to initiation by standard commercial detonators.

The carrier fluid may comprise a liquid and preferably it comprises water. In such cases the water-based explosive comprises a water resistant explosive. The carrier liquid may also be suitable to lubricate the passage of the water-based explosive through the delivery member. Water as carrier liquid serves as such a lubricant.

Alternatively the carrier fluid may comprise a gas and preferably the gas includes a lubricating agent for lubricating the passage of the water-based explosive through the delivery member. The lubricating agent may comprise water. In one preferred embodiment of the invention the carrier gas may comprise water-wet air.

1.2:1.

The water-based explosive and carrier in gaseous form may be fed into the delivery member at a carrier to explosive ratio from 2000:1 to 60000:1, preferably from 4500:1 to 18000:1 (volume basis) with the gas carrier volume being expressed (volume basis) with the gas carrier volume being expressed at standard temperature and pressure.

The water-based explosive may be fed under a pressure from 10 kPa to 600 kPa. preferably from 20 kPa to 400 kPa. And most preferably about 50 kPa to 240 kPa.

The carrier may be fed under pressure from 20 kPa to 650 kPa, preferably from 50 kPa to 400 kPa and most preferably about 100 kPa to 250 kPa.

In one embodiment of the invention the carrier may be fed into the delivery member in a manner to break up a column of the water-based explosive into discontinuous subsections. Preferably the subsections have diameters which are slightly smaller than the internal diameter of the tubular delivery member.

The tubular delivery member may comprise a pipe, including a hose.

The water-based explosive may be delivered into a blasthole, including a blasthole with a diameter of smaller than 100 mm. The water-based explosive is preferably sensitised for direct use in such blastholes, without the need to add additional sensitiser prior to delivery into such blastholes.

According to another aspect of the present invention there is provided a system for delivering a water-based explosive comprising:

feed means for feeding a water-based explosive;

feed means for feeding a fluid non-explosive carrier; and a mixing arrangement for mixing and providing the water-based explosive and carrier in a tubular delivery member in order that the water-based explosive defines a plurality of bodies separated from each other by the carrier.

The feed means for feeding the water-based explosive may comprise any suitable feed means, such as a pressurised vessel with an outlet through which the explosive may be fed, or a pump arrangement.

The feed means for feeding the carrier may comprise a source of fluid under pressure being fed through suitable conduits.

The mixing arrangement may comprise means for bringing together the fed explosive and carrier under conditions allowing a plurality of bodies of the water-based explosive to form. The conditions may be provided by regulating aspects such as feed ratio and pressures under which the water-based explosive and carrier are fed.

BRIEF DESCRIPTION OF THE DRAWINGS

The invention will now be further described with reference to the accompanying examples and drawings wherein.

DETAILED DESCRIPTION OF THE INVENTION

Figure 1:
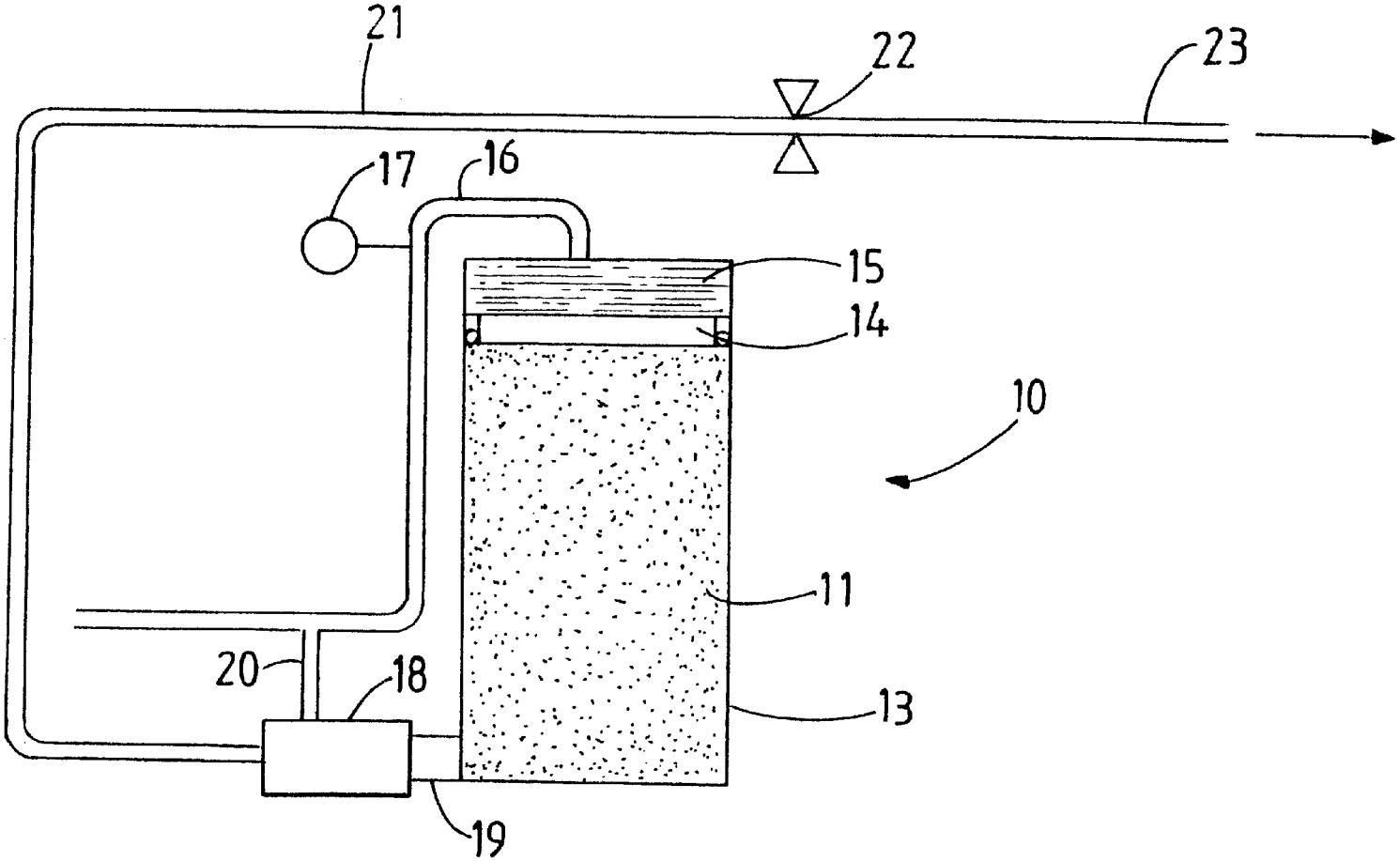
FIG. 1 is a diagrammatic view of an apparatus for carrying out the invention.
Figure 2:
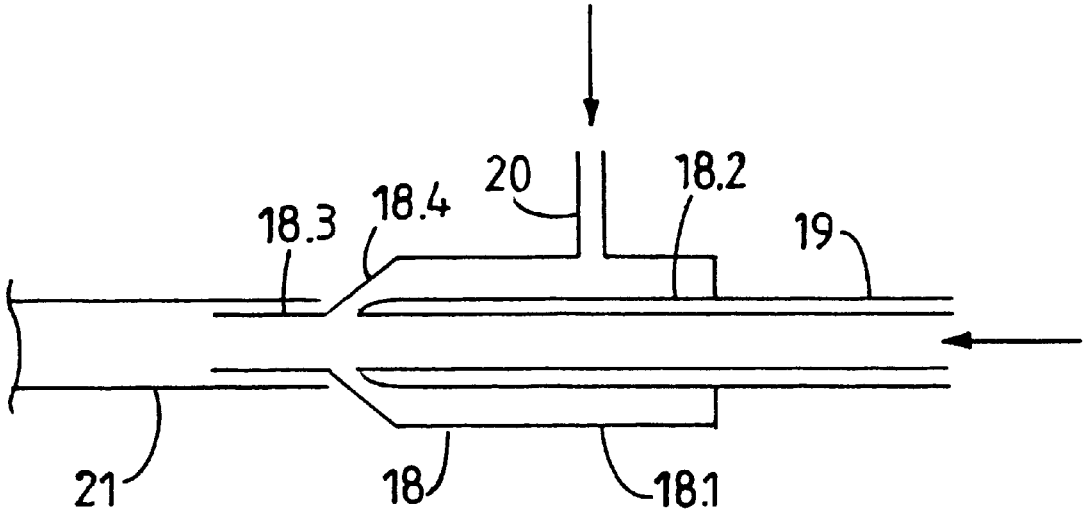
FIG. 2 is an enlarged diagrammatic view of an enveloper used in the apparatus of FIG. 1.

Referring now to FIGS. 1 and 2 a system 10 for delivering a water-based explosive 11 according to the present invention comprises a feed means for feeding the water-based explosive 11, said feed means comprising a cylinder 13 with a piston 14 therein. The piston is driven by water 15 from a supply of water which is supplied through supply line 16 which includes a pressure gauge 17. The cylinder 13 is operatively connected to an enveloper 18 via an outlet 19. A fluid non-explosive carrier in the form of water is supplied through feed line 20 to the enveloper 18. The enveloper 18 is connected to a delivery hose 21 which includes a valve 22 therein for controlling fluid flow therethrough. A lance 23 is also mounted to the delivery hose 21.

The enveloper 18 comprises a hollow body 18.1 and a tubular inlet 18.2 extending into the hollow body 18.1 to be enveloped by the hollow body 18.1. The feed line 20 is in fluid communication with the hollow body 18.1 in use to allow water to fill the body through the feed line 20. The tubular inlet 18.2 is secured to the outlet 19, and may be an extension of the outlet 19. In use explosive 11 is fed through the inlet 18.2. The enveloper 18 also includes an outlet 18.3 through which the water and explosive exits. In this embodiment of the invention the inlet 18.2 is in line with the outlet 18.3 and is spaced therefrom. The body 18.1 tapers at 18.4 to the outlet 18.3 thereby directing water in the hollow body 18.1 onto the explosive 11 which leaves the inlet 19, and the water also being directed into the outlet 18.3.

In use water under pressure is supplied to the enveloper 18 through supply line 20 and also onto the piston 14 through supply line 16. The piston 14 forces the water-based explosive 11 through outlet 19 and through the enveloper 18. By adjusting the ratio of explosive to water feed, a discontinuous explosive column was delivered in the hose 21 through the enveloper 18. The water flow was adjusted at 4 to 4.5 liters per minute and the explosive 11 was fed at 3 to 4 liters per minute. In the enveloper 18 the water supplied through supply line 20 breaks up the column of water-based explosive 11 fed through the enveloper into separate bodies in the form of smaller columns or bodies which are separated from each other by water which carry the water-based explosive 11 through the delivery hose 21. A discontinuous column of explosive 11 is thus fed through the hose 21.

Figure 3:
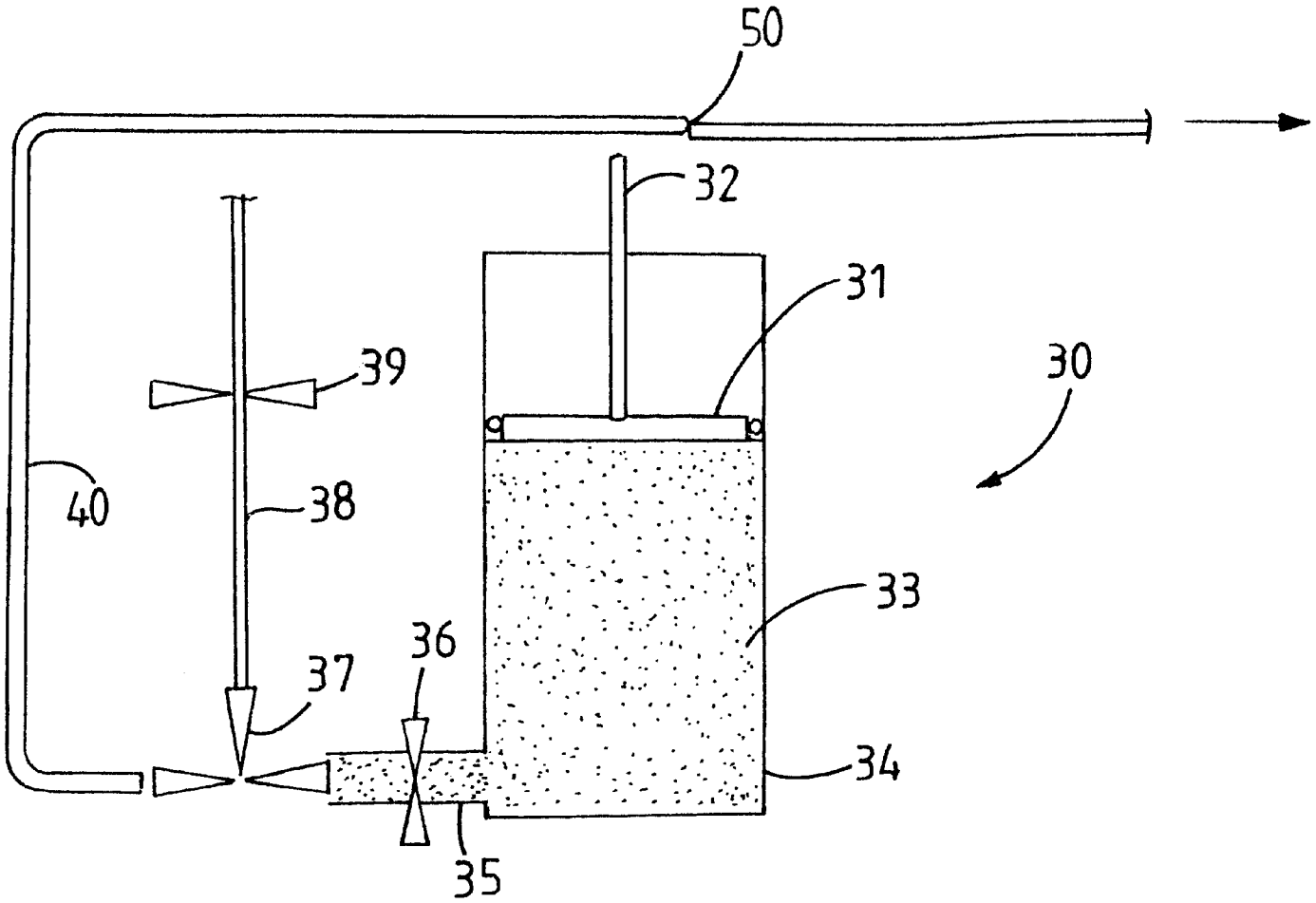
FIG. 3 is a diagrammatic view of another apparatus for carrying out the invention.

The system 30 of FIG. 3 is similar to the system 10. In this case a mechanically driven piston 31 (including rod 32)

feeds the water-based explosive 33 through cylinder 34 and outlet 35. A two-way valve 36 is provided in the outlet 35 and is followed by a three-way valve 37. A water supply is connected to the valve 37 through supply line 38 with a valve 39 therein. The valve 37 is also connected to a delivery hose 40 with a lance 50 mounted thereto.

In use water is supplied through the supply line 38 to fill the hose 40. The water-based explosive is then fed under pressure through the outlet 35. By the synchronised alternate opening and closing of the valves 36 and 37 alternate delivery of explosive 33 and water into the hose 40 is achieved to provide columns of explosive separated from each other by columns of water. A discontinuous column of explosive 33 is thus fed through the hose 40.

Figure 4:
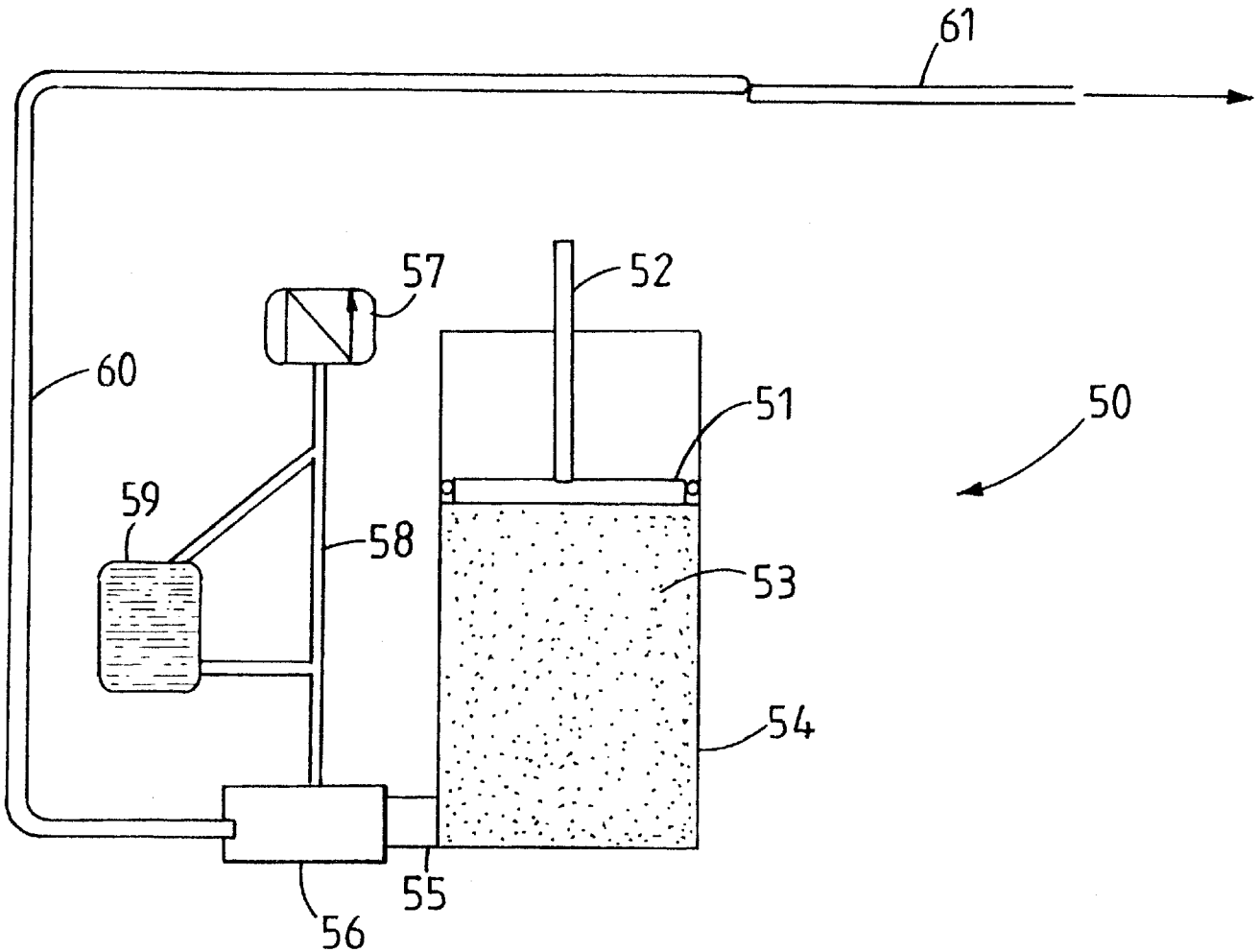
FIG. 4 is a diagrammatic view of yet another apparatus for carrying out the invention.

The system 50 of FIG. 4 is similar to the systems 10 and 30. In this case a mechanically driven piston 51 (including rod 52) feeds the water-based explosive 53 through cylinder 54 and outlet 55 to an enveloper 56 which is the same as the enveloper 18 shown in FIG. 2. Compressed air is fed through a regulator 57 and supply line 58 to the enveloper 56. A coupling arrangement 59 feeds water 62 into supply line 58 to introduce water droplets into the air stream to form "wet air".

In use as the explosive 53 and wet air is fed into the enveloper 56, the wet air breaks up the water-based explosive 53 into distinct bodies which are carried through the hose 60 and lance 61 to a point of delivery. The wet air lubricates passage of the explosive bodies through the hose 60. The bodies of water-based explosive are carried in a stream of air and there is no continuous column of explosive extending through the hose 60.

EXAMPLE 1

The system 10 of FIGS. 1 and 2 was used to charge an emulsion explosive, in this example, EMEX JUMBO SB a product supplied by Sasol SMX. The emulsion explosive had a viscosity of 440 000 cps with Brookefield HA7 spindle at 10 rpm at 25° C. The emulsion explosive had a density of 0.9 g/cc and was conveyed through 6 m of 19 mm internal diameter hose (21) and charged into 40 mm internal diameter receiving tubes. The loading time for 1 kg discharge in consecutive tubes was 15 to 20 seconds.

Detonative discontinuity in the hose was confirmed by interrupting a loading sequence and removing the hose (21) containing the in transit explosive. The hose (21) was primed with a 6D detonator from delivery end and the detonation progressed for 3 m before being halted.

EXAMPLE 2

The system 10 of FIGS. 1 and 2 was used to charge the emulsion explosive of Example 1. In this case the emulsion explosive had a viscosity of 344 000 cps with a Brookefield HA7 spindle of 10 rpm and 25° C. The emulsion explosive had a density of 1.14 g/cc and was again conveyed through 6 m of 19 mm internal diameter hose (21) and again charged into 40 mm internal diameter receiving tubes. The loading time was the same as for Example 1.

EXAMPLE 3

The system 10 was again used, this time to deliver a watergel explosive with the following composition by weight:

| | |
|---|---|
| Dry particulated ammonium nitrate | 61.29% |
| Sodium nitrate | 3.00% |
| MMAN | 25.7% |
| Water | 5.7% |
| Guar | 0.45% |
| Carbonaceous fuel | 0.69% |
| Microballoons (Expancel 551) | 0.50% |
| Polymeric thickener | 1.07% |
| Cross linkers | 0.09% |
| Stabilizers | 0.09% |

The explosive had a medium thickened consistency and was delivered through a 6 m of 19 mm internal diameter hose (21) by use of the system 10. The gel left the hose (21) in discontinuous sections.

EXAMPLE 4

The system 30 of FIG. 3 was used with the emulsion explosive of Example 2. The valves were manually opened and closed. A cycle of delivery explosive for 8 seconds followed by a delivery of water for 2 seconds was maintained to provide a discontinuous column of explosive in and through the hose 40.

EXAMPLE 5

The system of FIG. 4 was used with the emulsion explosive of Example 2. Water was fed from vessel 59 into tube 58 to form a water wet air mixture which was fed to the enveloper 56. At the same time the explosive was fed via outlet 55 through the enveloper 56. A regulated air supply was maintained using regulator 57. It was found that a water feed of 64 ml per min with air flow maintained at 200 kPa pressure conveyed and deliver 1.7 kg of explosives in a controlled and even fashion into a 40 mm tube in 17 to 20 seconds. The explosive left the lance in discontinuous sections. The plurality of explosive sections leaving the lance was conjoined into a continuous column in the receiving tube.

It will be appreciated that many variations in detail are possible without thereby departing from the scope and spirit of the invention.

What is claimed is:

1. A method of delivering a water-based explosive comprising:

feeding a pumpable water-based explosive and a fluid non-explosive carrier into a tubular delivery member in such a manner that during said feeding the water-based explosive is formed into a plurality of bodies separated from each other by the carrier; and feeding the bodies of water-based explosive separated by the carrier through the tubular delivery member to a point of delivery.

2. The method of claim 1 wherein the water-based explosive and carrier are fed into the delivery member so that the water-based explosive forms a plurality of bodies separated from each other sufficiently by the carrier to ensure that detonative continuity is not present in the delivery member.

3. The method of claim 1 wherein the feed rate of the carrier into the delivery member is higher than the feed rate of the explosive into the delivery member.

4. The method of claim 1 wherein the water-based explosive and carrier are fed into the delivery member by an enveloper means comprising a hollow body with an inlet for the carrier, an inlet for the explosive, and a joint outlet for the carrier and explosive; the enveloper means being constructed so that the carrier breaks up the explosive into bodies separated by the carrier both of which leave the enveloper through the outlet.

5. The method of claim 1 wherein the water-based explosive and carrier are fed in an alternating manner into the delivery member.

6. The method of claim 5 wherein the feed of both the water-based explosive and the carrier are interrupted in a synchronized alternating sequence by a valve means resulting in alternate delivery of explosive and carrier into the delivery member.

7. The method of claim 1 wherein the water-based explosive comprises a sensitized explosive sensitive to initiation by booster, priming charge or detonator.

8. The method of claim 1 wherein the fluid non-explosive carrier comprises water.

9. The method of claim 1 wherein the fluid non-explosive carrier comprises a gas.

10. The method of claim 1 wherein the carrier is fed into the delivery member in a manner that breaks up a column of the water-based explosive into discontinuous subsections.

11. The method of claim 10 wherein the subsections have diameters which are slightly smaller than the internal diameter of the tubular delivery member.

12. The method of claim 1 wherein the water-based explosive is delivered into a blasthole and wherein the water-based explosive is sensitized for direct use in such a blasthole.

13. A system for delivering a water-based explosive comprising:

first feed means for feeding a pumpable water-based explosive; second feed means for feeding a fluid non-explosive carrier; and a mixing arrangement for mixing and providing the water-based explosive and carrier in a tubular delivery member in such a manner that during the mixing the water-based explosive is formed into a plurality of bodies separated from each other by the carrier.

* * * * *